United States Patent [19]

Fleck

[11] Patent Number: 4,496,072

[45] Date of Patent: Jan. 29, 1985

[54] INSULATED CABINET COLLAR CORNER ELEMENT

[75] Inventor: George J. Fleck, Arnegard, N. Dak.

[73] Assignee: Whirlpool Corporation, Benton Harbor, Mich.

[21] Appl. No.: 428,414

[22] Filed: Sep. 29, 1982

[51] Int. Cl.[3] ..... F25D 23/08; B65D 88/74

[52] U.S. Cl. ..... 220/432; 220/444; 220/DIG. 3; 312/214

[58] Field of Search ..... 52/656, 738, 459–464, 52/468; 312/111, 140, 257 SK, 263, 214; 220/430–434, 444, DIG. 3, 467; 217/128

[56] References Cited

U.S. PATENT DOCUMENTS

| | | | |
|---|---|---|---|
| 2,286,109 | 6/1942 | Rundell | 220/434 |
| 2,329,755 | 9/1943 | Goulooze . | |
| 2,358,221 | 9/1944 | Drake . | |
| 2,540,940 | 2/1951 | Ganzer | 220/467 X |
| 2,581,692 | 1/1952 | Morton et al. . | |
| 2,662,660 | 12/1953 | Frykdahl | 220/431 |
| 2,855,636 | 10/1958 | Donnelly | 220/434 X |
| 2,873,041 | 2/1959 | Allen | 220/433 |
| 2,940,632 | 6/1960 | Dickenson et al. . | |
| 2,978,136 | 4/1961 | Ehrenfreund | 220/467 X |
| 2,989,156 | 6/1961 | Brooks et al. | 220/467 X |
| 3,007,224 | 11/1961 | Wean | 220/80 X |
| 3,010,548 | 11/1961 | Canalini | 52/656 X |
| 3,142,405 | 7/1964 | Johnson . | |
| 3,270,907 | 9/1966 | Swaneck, Jr. | 220/434 |
| 3,338,451 | 8/1967 | Kesling | 220/431 |
| 3,380,615 | 4/1968 | Kessler | 220/443 |
| 3,632,012 | 1/1972 | Kitson . | |
| 3,642,164 | 2/1972 | O'Neal et al. . | |
| 3,868,152 | 2/1975 | Dixon | 220/444 X |
| 3,915,328 | 10/1975 | Hawes et al. . | |
| 4,196,952 | 4/1980 | Crowe | 312/140 X |
| 4,332,429 | 6/1982 | Frick et al. | 312/214 X |

*Primary Examiner*—Stephen Marcus
*Assistant Examiner*—Robert Petrik
*Attorney, Agent, or Firm*—Wood, Dalton, Phillips, Mason & Rowe

[57] ABSTRACT

A cabinet structure having upstanding sidewalls defining vertical corners. The sidewalls include an inner liner, an outer shell, and foamed-in-place insulation between the liner and shell. A first breaker collar extends between the shell and liner across the insulation space. A second breaker collar extends between the shell and liner across the insulation space, with the breaker collars having spaced end portions at a corner of the cabinet. A collar corner element is installed across the space between the breaker collar ends at the corner and includes temporary locking structure for holding the corner element in place during the forming of the foamed-in-place insulation. The corner element further includes a locking wall extending into the insulation space so as to be embedded in the foamed-in-place insulation upon completion of the foaming operation. A number of different structures for effecting the temporary retention of the corner element in the cabinet structure during the foaming operation are disclosed.

16 Claims, 9 Drawing Figures

FIG. 1
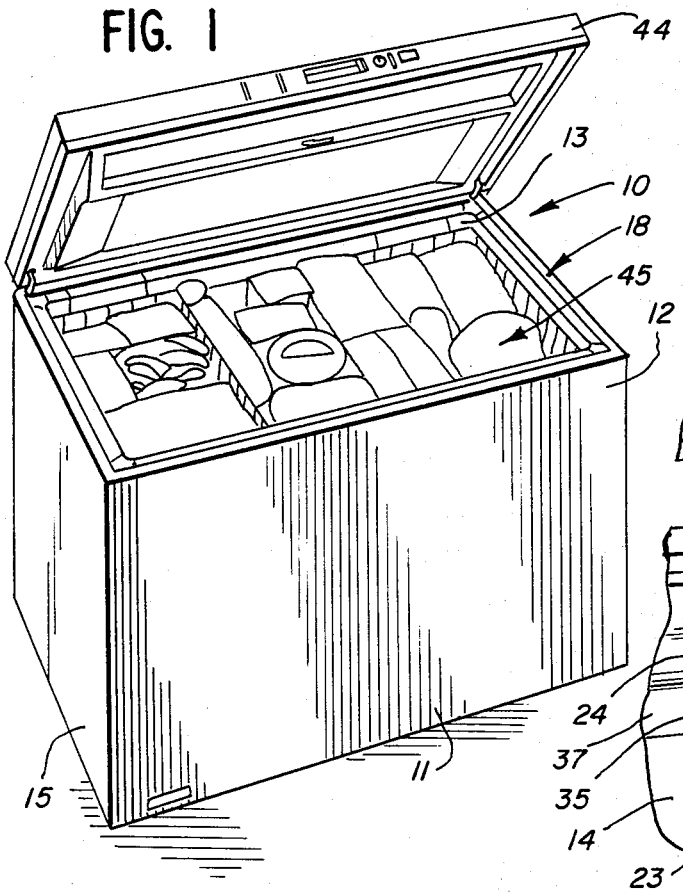
FIG. 2
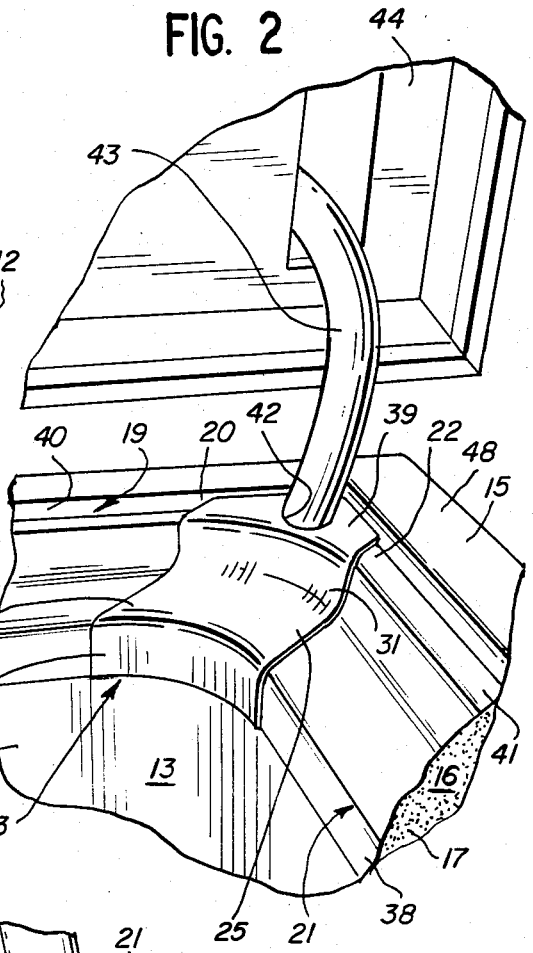
FIG. 3
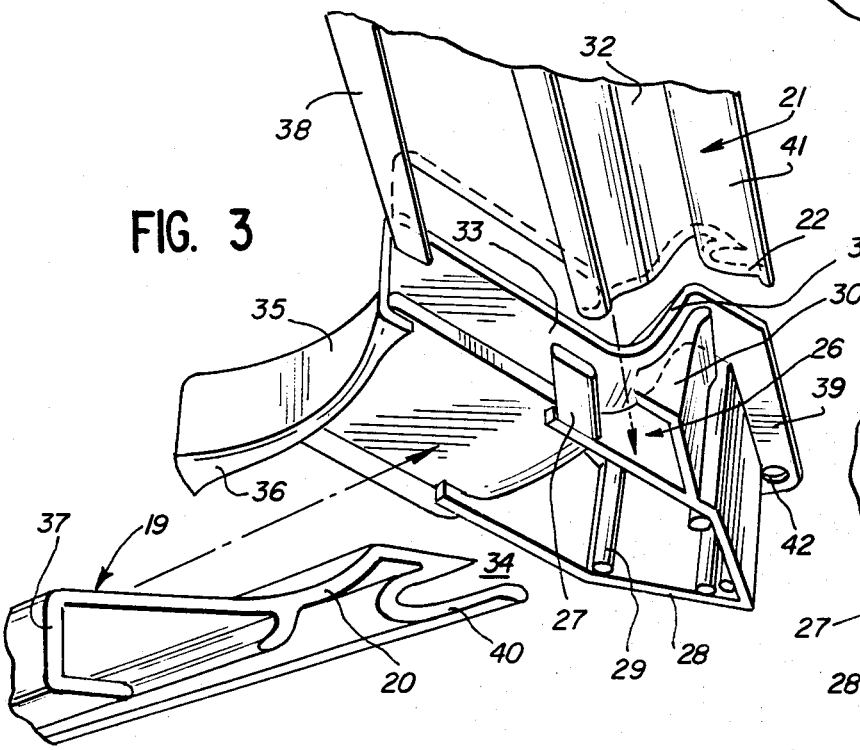
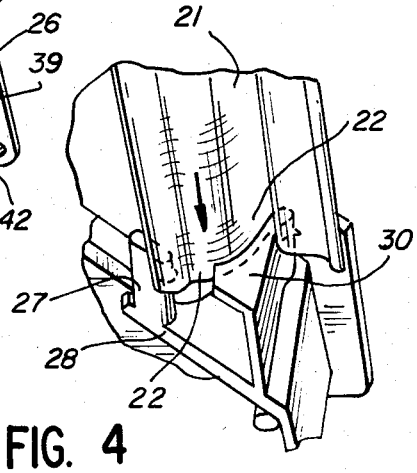
FIG. 4

FIG. 5
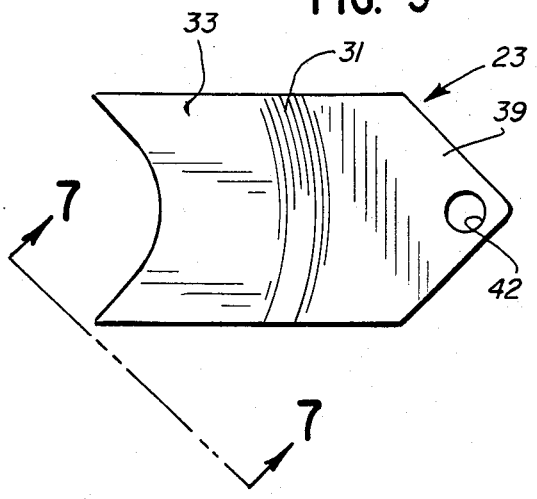
FIG. 6
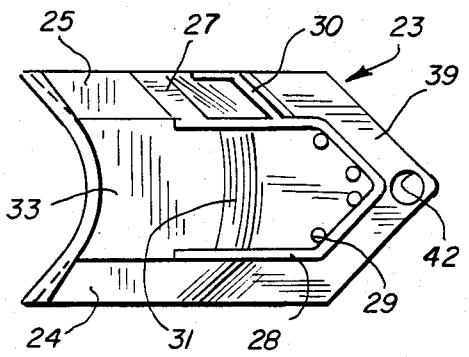
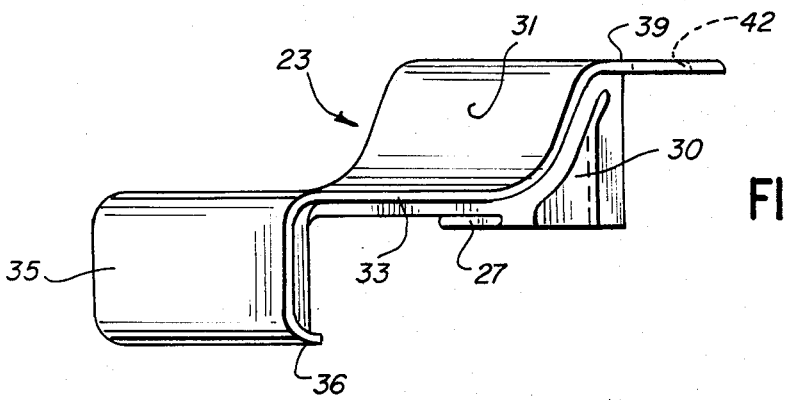
FIG. 7
FIG. 8
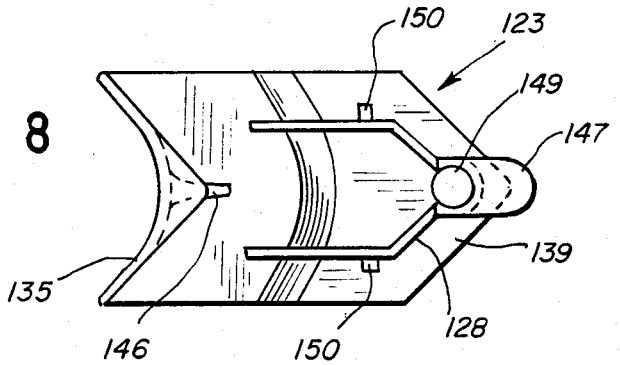
FIG. 9
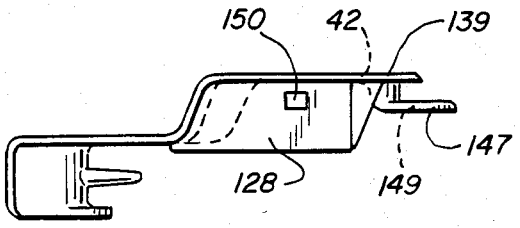

INSULATED CABINET COLLAR CORNER ELEMENT

BACKGROUND OF THE INVENTION

1. Field of the Invention

This invention relates to cabinet structures and in particular to collar elements for use in insulated cabinet structures.

2. Description of the Background Art

In U.S. Pat. No. 2,329,755, Martin J. Goulooze shows a corner strip for joining the abutting edges of adjacently attached breaker strips. The corner strips include side portions embracing opposite sides of the end of the breaker strip for locking the corner strip thereto. The corner strip is contoured in conformity to the breaker strip and is attached by sliding it downwardly from an outer corner of the abutting breaker strips toward its inner corner with edge portions thereof engaging behind an edge of the breaker strip. A top edge portion of the corner strip acts as a stop engaging over and under the outer side edge of the breaker strip.

Two additional forms of corner strips are illustrated in U.S. Pat. No. 2,358,221 of Earl D. Drake. As shown therein, one corner strip includes a top, or cover section, a turned extending section forming a diagonal end, and a back section. A tongue is punched adjacent one end in the cover section, and another tongue is punched in the back section. One edge of the back section is curled. This corner strip is attached by sliding the top section horizontally with the top breaker strip so as to overlap the adjacent edges of the breaker strips. The end of the cover section enters a pocket, with the tongue thereof entering a slot formed in the breaker strip. The slot is elongated sufficiently for the tongue to enter before entering the pocket, after which it is held in locking engagement by the pressure of the breaker strip toward the front wall. The curled edge hooks over an edge of the breaker strip and the tongue, in the back section, locks behind an edge of the breaker strip. Engagement of the curled portion over the edge of the breaker strip, together with the tongue in the cover section engaging behind the edge of the breaker strip, forms an interlocking relationship between the adjacent breaker strips and between the breaker strips and corner strip. Removal of the corner strip is prevented by the back section tongue abutting the edge of the breaker strip.

In the second form, the corner strip is formed with one end bent to form a U, with a back section in spaced parallel relationship to the top section and joined thereto by a connecting section. The opposite end is formed with vertical arms arranged in a V configuration and joined with the top section. The arms are adapted to lie behind the adjacent ends of the breaker strips and serve to center the top portion of the corner strip in overlapping relationship with the adjacent ends of the breaker strips. The end of the corner strip with the V configured arms lies within a pocket of the breaker strip. A section on the opposite end of the corner strips serves as a diagonal corner for the adjacent joining edges of the breaker strip, with the back section thereof locking between the front wall and the turned edge of each breaker strip by means of tongues held in abutment against an edge of the respective breaker strips so as to prevent withdrawal of the corner strip.

Still another form of corner member is illustrated by Evans T. Morton et al, in U.S. Pat. No. 2,581,692. As shown therein, the corner strip comprises a metallic bar secured diagonally across the corner of the cabinet structure and having offset end portions attached to flanges of the outer walls of the food compartment. The middle portion of the bar is threaded to receive a stud with a block clamped between the bar and the bottom of a cup-shaped body.

J. R. Dickenson et al disclose another form of corner element in U.S. Pat. No. 2,940,632. The corner piece has a front plate portion of right angular sections overlying the adjacent vertical and horizontal attaching strips and a sidewall plate portion formed as an integral part thereof extending at right angles to the front plate portion, and having right angular sections overlying the adjacent vertical and horizontal sides of the attaching strips. The front and right angular side plates have shoulders at opposite ends adapted to align with the ends of the straight sections of the breaker strip, and thin sections projecting laterally beyond the shoulders and overlying the ends of the straight sections. The thin sections are of the same contour in cross section as the end portions of the breaker strip and are gradually tapered to provide a feather edge engaging the straight sections. The right angular sections of the front plate have pins in locking engagement with shoulders on the attaching strips and a flange engaging the opposite sides of the attaching strip to yieldingly hold the pins in locking engagement. The side plate sections have a locking shoulder for locking engagement with the shoulder on the attaching strip and a spring clip projecting from the rear of the wall for yieldingly holding the shoulders in latching engagement.

In U.S. Pat. No. 3,915,328, Frederick L. Hawes et al disclose a breaker strip assembly having corners reinforced by tabs. The tabs unite and reinforce the mitered corners and prevent separation and tearing thereof as a result of expansion and contraction forces due to temperature differences at which the plastic in the frame is formed and at which the frame is used.

SUMMARY OF THE INVENTION

The present invention comprehends an improved cabinet structure having a corner element for the breaker collars which are interconnected with the outer shell and inner liner portion of the cabinet prior to introduction of foam insulation therebetween.

The corner trim element includes means for embracing the ends of the breaker collars at the corner to hold the corner element in preassembled relationship with the cabinet structure during the forming of the foamed-in-place insulation.

The corner elements further include locking means extending downwardly into the insulation space to be embedded in the foamed-in-place insulation for further locking the corner elements effectively in the cabinet structure.

The corner elements further include underturned front edge portions extending about the lower edge of the breaker collar.

The corner elements define a through opening through which a hinge element extends for movably associating a closure with the cabinet.

More specifically, in the illustrated embodiment, the improved collar corner element is provided for use in a cabinet structure having an upstanding sidewall defining a vertical corner, the wall comprising an inner liner, an outer shell defining with the liner an intermediate insulation space, foamed-in-place insulation in said space, a first breaker collar extending between the shell and liner over the space and having an end adjacent one side of the corner, and a second breaker collar extending between the shell and liner over the space and having an end adjacent the other side of the corner.

Thus, as shown, the collar corner element extends between the shell and liner over the insulation space at the corner and includes edge portions overlying the breaker collar ends, flange means underlying at least one of the breaker collar ends for retaining the corner element in association with the breaker collar ends, and locking means extending downwardly on the corner element into the insulation space and embedded in the foamed-in-place insulation to lock the corner element effectively in the cabinet structure.

In the illustrated embodiment, hinge means are provided for movably mounting the closure to the sidewall and include a connector element extending from the closure into the insulation space at the corner of each of the inside corners of the cabinet structure. The corner element, at each of the inside corners, defines a through opening through which the connector element extends.

A torsion bar hinge structure as disclosed in U.S. Pat. No. 3,233,276, Swanson et al, assigned to the same assignee as the present invention, is advantageous for attaching the closure lid to the cabinet wall structure for several reasons including the fact that passage of the cabinet through a narrow door opening is facilitated since the hinge structure is substantially contained within the closure or lid because no projections beyond the confines of the lid are required.

In the illustrated embodiment, the locking means for the corner element includes a wall extending into the foamed-in-place insulation. Reinforcing means are provided at spaced positions along the wall for rigidifying the same in locking the corner element in the corner structure.

The flange means, in the illustrated embodiment, define a plurality of spaced flanges for underlying one of the breaker collar elements at spaced positions. The flange means, in the illustrated embodiment, underlies only one of the breaker collar ends, thereby permitting the corner element to be installed between the breaker collar edges, with the first and second breaker collars fixedly positioned with their ends in spaced relationship at the corner.

In one embodiment, the corner element further includes a locking portion projecting outwardly into the liner at the corner.

In one embodiment, the corner element includes laterally projecting lugs under the edge portion projecting into the ends of the breaker collars.

In one embodiment, the corner element includes a locking tab disposed under a flange provided on the shell for further locking the corner element in the cabinet structure.

In the illustrated embodiment, the cabinet comprises an upwardly opening chest, with the closure comprising a cover movably mounted to the chest by a torsion-bar hinge element.

Thus, the cabinet structure of the present invention utilizing the improved collar corner element is extremely simple and economical of construction while yet providing the highly desirable features discussed above.

BRIEF DESCRIPTION OF THE DRAWINGS

Other features and advantages of the invention will be apparent from the following description taken in connection with the accompanying drawings wherein:

FIG. 1 a perspective view of a cabinet structure having an improved collar corner element embodying the invention;

FIG. 2 is a fragmentary enlarged perspective view illustrating the corner element in greater detail;

FIG. 3 is an exploded upwardly looking fragmentary perspective view illustrating the corner element in greater detail;

FIG. 4 is a fragmentary perspective view of a portion of the structure of FIG. 3 illustrating the inner engagement of the corner element with one of the breaker collar ends;

FIG. 5 is a top plan view of the corner element;

FIG. 6 is a bottom plan view thereof;

FIG. 7 is a left side elevation thereof;

FIG. 8 is a bottom plan view of a modified form of corner element embodying the invention; and FIG. 9 is a left side elevation thereof.

DESCRIPTION OF THE PREFERRED EMBODIMENTS

In the illustrative embodiment of the invention as disclosed in FIGS. 1–7 of the drawing, a cabinet structure generally designated 10 in the form of a chest freezer is shown to include a cabinet 11 defined by upstanding sidewalls 12, in turn defining a plurality of vertically extending corners 13 of the parallelepiped configuration.

The sidewalls are defined by an inner liner 14, an outer shell 15 defining with the liner an intermediate insulation space 16 in which foamed-in-place insulation 17 is provided, and breaker collar means generally designated 18 extending between the shell and liner over space 16. In the illustrated embodiment, the breaker collar means includes a plurality of breaker collars, including a first breaker collar 19 extending over space 16 and having an end 20 adjacent one side of the corner 13. The breaker collar means 18 further includes a second breaker collar 21 overlying the space 16 and having an end 22 adjacent the opposite of the corner 13 in spaced relationship to end 20.

The gap between breaker collar ends 20 and 22 is closed by an improved collar corner element generally designated 23 which extends between th shell and liner over the insulation space at the conrner 13. While only one corner 13 is described in detail, it will be understood that the other corners are similarly arranged with the inside corner elements including through openings through which extend hinge elements.

As shown, the corner element includes first edge portion 24 overlying breaker collar end 20 and an opposite, second edge portion 25 overlying breaker collar end 22.

The corner element further includes flange means 26 including a flange 27 underlying breaker collar end 22, as illustrated in FIG. 4, for retaining the corner element in association with the breaker collar end.

As further illustrated in FIG. 3, flange 27 is provided as an angularly projecting integral extension of a locking wall 28 extending vertically downwardly so as to be embedded in the foamed-in-place insulation 17 during the foaming operation. Thus, as will be apparent, the locking wall 28 with its projection 27 and other projections described below serves to effectively positively secure the corner element to the cabinet structure through such embedment in the insulation.

As illustrated in FIG. 3, locking wall 28 has a generally U-shaped cross section and is provided with a plurality of reinforcing ribs 29 at spaced positions along the wall for rigidifying the wall when locking the corner element in the cabinet structure.

A second angularly projecting flange 30 is provided on wall 28 rearwardly of an upturned rear portion 31 of the corner element so as to receive a complementary upturned portion 32 of the breaker strip 21 therebetween. As shown in FIG. 3, flange 27 is spaced below a front, generally planar portion 33 of the corner element. End portion 22 of breaker collar 21 is similarly configured so as to be received in a space between flange 30 and corner element portion 31 and the space between flange 27 and corner element portion 33 as a result of the urging of the corner element laterally into such association when inserted in the space generally designated 34 between the breaker collar ends 20 and 22. Thus, as seen in FIG. 2, the breaker collars may be substantially fixedly installed in the cabinet through the installation of the corner element 23 and prior to the insulation foaming operation.

In the illustrated embodiment, the opposite side of the corner element is free of such flanges so as to permit the installation by movement of the corner element into space 34 from overlying end 20 of breaker collar 19 to the right, as seen in FIG. 2, to bring the flanges 27 and 30 into underlying relationship with breaker collar end 22, as discussed above.

As further seen in FIGS. 2, 3 and 7, the corner element further includes a downturned inner flange 35 having a returned distal end portion 36 complementary to and overlying downturned and returned inner flanges portions 37 and 38 on breaker collars 19 and 21, respectively.

The corner element further includes an outer, substantially planar portion 39 which overlies an outer connector portion 40 of breaker collar 19, and a similar outer connector portion 41 of breaker collar 21, as seen in FIG. 2 in the installed disposition of the corner element.

Outer portion 39 of the corner element may be provided with a through opening 42 through which extends a rod portion 43 of a torsion-bar hinge structure hingedly mounting a closure lid, or door, 44 to the cabinet for selectively closing the interior space 45 of the cabinet in a closed position of the closure, or providing access thereto in an open position of the closure, as illustrated in FIG. 1.

The invention further contemplates additional means for retaining the corner element in association with the cabinet. Thus, as illustrated in FIGS. 8 and 9, a modified form of corner element generally designated 123 is shown to include on the front flange 135 a rearwardly extending projection 146 adapted to extend outwardly through the corner 13 of liner 14. As will be obvious to those skilled in the art, the liner may be provided with a suitable opening to receive the projection 146, as desired.

As further illustrated in FIGS. 8 and 9, the corner element may include a rearwardly projecting tab 147 to underlie the inturned flange 48 of shell 15 to which the connector portions 40 and 41 of the breaker collars are connected. As shown in FIGS. 8 and 9, the tab, in the illustrated embodiment, projects from the locking wall 128 subjacent the planar outer portion 139 of the corner element for facilitated reception of shell flange 48 therebetween. As further illustrated in FIG. 8, tab 147 may be provided with a through opening 149 aligned with opening 42 for passing the hinge rod 43.

Still further, as illustrated in FIGS. 8 and 9, the corner element may include additional locking elements in the form of laterally projecting lugs 150 extending oppositely outwardly from the locking wall 128 so as to be received under the breaker collar edges 20 and 22 for further retaining the corner element in the cabinet structure.

Thus, the invention comprehends the provision of an improved readily installable corner element for bridging the gap between the mitered end portions of breaker collars at the corner of an insulated cabinet. The corner element includes means for temporarily retaining it in association with the cabinet structure prior to the forming of the foamed-in-place insulation in the insulation space between the inner liner and outer shell walls. The corner element includes locking means extending into the insulation space so as to be embedded in the foamed-in-place insulation upon completion of the foaming operation so as to fixedly secure the corner element in the cabinet structure.

In the illustrated embodiments, the corner element is provided with temporary retaining means arranged to permit facilitated installation of the corner element between the mitered ends of the breaker collars at the corners of the cabinet, as by a simple mechanical insertion of the corner element into retained association with one of the breaker collar end portions.

The corner element includes inner and outer flange portions overlying associated portions of the cabinet so as to provide a neat, attractive corner in the cabinet construction. In the illustrated embodiment, the corner element is formed of a synthetic resin as a one-piece element. Thus, the corner element is extremely simple and economical of construction while yet providing the highly desirable features discussed above.

The foregoing disclosure of specific embodiments is illustrative of the broad inventive concepts comprehended by the invention.

I claim:

1. In a cabinet structure having an upstanding sidewall defining a vertical corner, said wall comprising an inner liner, an outer shell defining with said liner an intermediate insulation space, foamed-in-place insulation in said space, a first breaker collar extending between said shell and liner over said space and having an end adjacent one side of said corner, and a second breaker collar extending between said shell and liner over said space and having an end adjacent the other side of said corner, said cabinet structure further defining a closure and torsion bar hinge means for removably mounting said closure to said sidewall comprising a connector element extending from said closure downwardly into said insulation space at said corner, the improvement comprising a collar corner element extending between said shell and liner over said space at said corner, said corner element having edge portions overlying said breaker collar ends, flange means underlying at least one of said breaker collar ends for retaining the corner element in association with said breaker collar ends, and locking means extending downwardly on said corner element into said insulation space and embedded in said foamed-in-place insulation to lock the corner element effectively in the cabinet structure, said corner element further defining a through opening through which said connector element extends.

2. In a cabinet structure having an upstanding sidewall defining a vertical corner, said wall comprising an inner liner, an outer shell defining with said liner an intermediate insulation space, foamed-in-place insulation in said space, a first breaker collar extending between said shell and liner over said space and having an end adjacent one side of said corner, and a second breaker collar extending between said shell and liner over said space and having an end adjacent the other side of said corner, said cabinet structure further defining a closure and hinge means for removably mounting said closure to said sidewall comprising a connector element extending from said closure downwardly into said insulation space at said corner, the improvement comprising a collar corner element extending between said shell and liner over said space at said corner, said corner element having edge portions overlying said breaker collar ends, flange means underlying at least one of said breaker collar ends for retaining the corner element in association with said breaker collar ends, and locking means extending downwardly on said corner element into said insulation space and embedded in said foamed-in-place insulation to lock the corner element effectively in the cabinet structure, said corner element further defining a through opening through which said connector element extends.

3. The cabinet structure of claims 1 or 2 wherein said corner element further includes an inner turned flange underlying the breaker collar ends inwardly of the inner liner at said corner.

4. The cabinet structure of claims 1 or 2 wherein said locking means comprises a wall extending vertically downwardly into said foamed-in-place insulation.

5. The cabinet structure of claims 1 or 2 wherein said locking means comprises a wall extending vertically downwardly into said foamed-in-place insulation and having reinforcing portions at spaced positions along said wall for rigidifying said wall in locking the corner element in the cabinet structure.

6. The cabinet structure of claims 1 or 2 wherein said flange means comprises a plurality of spaced flanges for underlying said at least one breaker collar at spaced positions.

7. The cabinet structure of claims 1 or 2 wherein said flange means projects angularly from said locking means.

8. The cabinet structure of claims 1 or 2 wherein said flange means projects angularly from said locking means and is formed integrally therewith.

9. The cabinet structure of claims 1 or 2 wherein said corner element comprises an integral one-piece element.

10. The cabinet structure of claims 1 or 2 wherein said flange means comprises flange means underlying only one of said breaker collar ends for permitting said corner element to be installed between said breaker collar edges with said first and second breaker collars fixedly positioned with said ends in spaced relationship at said corner.

11. The cabinet structure of claims 1 or 2 wherein said breaker collars and corner element are formed of synthetic resin.

12. The cabinet structure of claims 1 or 2 wherein said corner element further includes an inner locking portion projecting outwardly toward said liner at said corner.

13. The cabinet structure of claims 1 or 2 wherein said corner elements further include laterally projecting lugs under said edge portion positioned to be disposed under said ends of the breaker collars.

14. The cabinet structure of claims 1 or 2 wherein said corner element further includes a locking tab, and said shell includes an inwardly turned flange, said tab being disposed under said shell flange for further locking the corner element in the cabinet structure.

15. In a cabinet structure having an upstanding sidewall defining a vertical corner, said wall comprising an inner liner, an outer shell defining with said liner an intermediate insulation space, foamed-in-place insulation in said space, a first breaker collar extending between said shell and liner over said space and having an end adjacent one side of said corner, and a second breaker collar extending between said shell and liner over said space and having an end adjacent the other side of said corner, the improvement comprising a collar corner element extending between said shell and liner over said space at said corner, said corner element having edge portions overlying said breaker collar ends, flange means underlying at least one of said breaker collar ends for retaining the corner element in association with said breaker collar ends, and locking means extending downwardly on said corner element into said insulation space and embedded in said foamed-in-place insulation to lock the corner element effectively in the cabinet structure, said corner element further including a locking portion projecting outwardly into said liner at said corner, laterally projecting lugs under said edge portion projecting into said ends of the breaker collars, and a locking tab, and said shell includes an inwardly turned flange, said tab being disposed under said shell flange for further locking the corner element in the cabinet structure.

16. In a cabinet structure having an upstanding sidewall defining a vertical corner, said wall comprising an inner liner, an outer shell defining with said liner an intermediate insulation space, foamed-in-place insulation in said space, a first breaker collar extending between said shell and liner over said space and having an end adjacent one side of said corner, and a second breaker collar extending between said shell and liner over said space and having an end adjacent the other side of said corner, the improvement comprising a collar corner element extending between said shell and liner over said space at said corner, said corner element having edge portions overlying said breaker collar ends, flange means underlying at least one of said breaker collar ends for retaining the corner element in association with said breaker collar ends, and locking means extending downwardly on said corner element into said insulation space and embedded in said foamed-in-place insulation to lock the corner element effectively in the cabinet structure, said corner element further including a locking portion projecting outwardly into said liner at said corner, laterally projecting lugs under said edge portion projecting into said ends of the breaker collars, and a locking tab, and said shell includes an inwardly turned flange, said tab being disposed under said shell flange for further locking the corner element in the cabinet structure.

* * * * *